US012680234B2

(12) United States Patent
Constantine

(10) Patent No.: US 12,680,234 B2
(45) Date of Patent: Jul. 14, 2026

(54) ANTI-WIGGLE CLIP SHOULDER FOR RAIL FASTENER

(71) Applicant: Progress Rail Services Corporation, Albertville, AL (US)

(72) Inventor: Edward Constantine, Belton (MO)

(73) Assignee: Progress Rail Services Corporation, Albertville, AL (US)

( * ) Notice: Subject to any disclaimer, the term of this patent is extended or adjusted under 35 U.S.C. 154(b) by 913 days.

(21) Appl. No.: 17/893,757

(22) Filed: Aug. 23, 2022

(65) Prior Publication Data

US 2024/0068173 A1 Feb. 29, 2024

(51) Int. Cl.

| | |
|---|---|
| ***E01B 9/60*** | (2006.01) |
| ***E01B 9/30*** | (2006.01) |
| ***E01B 9/48*** | (2006.01) |
| ***E01B 13/02*** | (2006.01) |

(52) U.S. Cl.

CPC ..... *E01B 9/60* (2013.01); *E01B 9/30* (2013.01); *E01B 9/483* (2013.01); *E01B 13/02* (2013.01)

(58) Field of Classification Search

CPC ... E01B 9/30; E01B 9/483; E01B 9/60; E01B 13/02; E01B 9/303; E01B 9/02

See application file for complete search history.

(56) References Cited

U.S. PATENT DOCUMENTS

| | | | | |
|---|---|---|---|---|
| 3,970,248 | A * | 7/1976 | Molyneux | E01B 9/303 238/349 |
| 4,047,663 | A * | 9/1977 | Reynolds | E01B 9/483 238/349 |
| 4,074,860 | A * | 2/1978 | Rex | E01B 9/30 238/349 |
| 4,326,670 | A * | 4/1982 | Sherrick | E01B 9/66 238/349 |
| 4,413,777 | A | 11/1983 | Brown | |
| 4,469,278 | A * | 9/1984 | Jerman | E01B 9/30 238/349 |
| 4,715,534 | A * | 12/1987 | Fee | E01B 9/303 238/349 |
| 5,718,376 | A * | 2/1998 | Cox | E01B 9/303 238/349 |
| 10,081,915 | B2 * | 9/2018 | Constantine | E01B 9/483 |
| 10,240,299 | B2 * | 3/2019 | Constantine | E01B 9/62 |
| 11,396,729 | B2 * | 7/2022 | Constantine | E01B 9/02 |

(Continued)

FOREIGN PATENT DOCUMENTS

| | | | | |
|---|---|---|---|---|
| BE | 897056 | A | 10/1983 | |
| EP | 0126835 | A1 * | 12/1984 | E01B 9/303 |

(Continued)

OTHER PUBLICATIONS

Written Opinion and International Search Report for Int'l. Patent Appln. No. PCT/US2023/070874, mailed Oct. 23, 2023 (14 pgs).

*Primary Examiner* — Cheng Lin

(57) ABSTRACT

A direct fixation track rail fastener includes a first clip shoulder and a second clip shoulder each having a clip tunnel formed therein. Each clip tunnel is formed in part by a plurality of clip contact faces defining a first prong contact line and a second prong contact line for a prong of a rail clip. The configuration of multiple line contacts prevents undesired displacement of a rail clip during service.

20 Claims, 3 Drawing Sheets

(56) References Cited

U.S. PATENT DOCUMENTS

| | | | | |
|---|---|---|---|---|
| 2008/0000999 | A1* | 1/2008 | Remington | E01B 9/60 238/167 |
| 2015/0060561 | A1* | 3/2015 | Ciloglu | E01B 26/00 238/315 |
| 2016/0298298 | A1* | 10/2016 | Constantine | E01B 9/62 |
| 2018/0023257 | A1 | 1/2018 | Constantine et al. | |
| 2021/0047785 | A1 | 2/2021 | Constantine | |
| 2021/0207329 | A1 | 7/2021 | Osler | |

FOREIGN PATENT DOCUMENTS

| | | | |
|---|---|---|---|
| GB | 1486451 | | 9/1977 |
| JP | 4845616 | B2 | 12/2011 |
| KR | 100958734 | B1 | 5/2010 |
| KR | 20150001311 | A | 3/2017 |
| KR | 102090262 | B1 | 3/2020 |

* cited by examiner

ANTI-WIGGLE CLIP SHOULDER FOR RAIL FASTENER

TECHNICAL FIELD

The present disclosure relates generally to a direct fixation fastener for track rail, and more particularly to such a fastener configured to limit undesired movement of a rail clip in service.

BACKGROUND

Rail equipment is used globally for transporting persons and all manner of goods and equipment. Rail lines for freight, passenger, or commuter trains are formed by parallel track rails supported upon a substrate, as will be familiar to many. Many different mechanisms are known for positioning, supporting, and fastening the track rails as well as managing loads and vibrations transmitted by way of the rail and fasteners between rail equipment and the underlying substrate. Rail fastening and fixation systems include simple plates attaching rails to wooden ties, as well as highly engineered direct fixation fasteners formed from an assembly of metallic and non-metallic parts.

During service, fasteners can be subjected to significant loads and vibrations as they accommodate transit of locomotives and rail cars upon the supported rails. The rails themselves are often secured to the fasteners by way of rail clips, commonly so-called "E-clips." In one typical example, a section of rail is placed upon a surface of a rail plate, and rail clips hammered into receptacle holes in the fastener to engage a toe portion of the rail clip in contact with the base of the rail. In this general way, friction and spring clamping force of the rail clips secure the rail to numerous fasteners spaced longitudinally along the rail.

During service, loads and vibrations, including longitudinally directed loads on the track rail, vertical loads, and lateral loads can cause connections among the various components to shift, degrade in performance, or even fail. One known direct fixation fastener strategy is set forth in U.S. Pat. No. 10,081,915 to Constantine.

SUMMARY

In one aspect, a direct fixation track rail fastener includes a fastener body having a first clip shoulder, a second clip shoulder, and a rail plate having an upward facing rail contact surface positioned laterally between the first clip shoulder and the second clip shoulder and extending in a fore-aft direction between a fastener body forward edge and a fastener body back edge. The first clip shoulder and the second clip shoulder include a first clip tunnel and a second clip tunnel, respectively, each formed in part by a plurality of clip contact faces, finite in number, oriented to react an upward clamp load from a rail clip prong and defining a first prong contact line and a second prong contact line, each extending in a fore-aft direction.

In another aspect, a track rail fastener includes a fastener body having a lower, substrate-facing side, and an upper side, and including a heel support surface upon the upper side extending in a fore-aft direction between a fastener body forward edge and a fastener body back edge, and in a lateral direction between a clip shoulder and a fastener body lateral edge. The clip shoulder includes a clip tunnel extending in a fore-aft direction and formed in part by a plurality of clip contact faces. The plurality of clip contact faces define a first prong contact line and a second prong contact line on a cylinder extending in the fore-aft direction through the clip tunnel. The first prong contact line and the second prong contact line together define an upwardly opening angle having a vertex at an axis of the cylinder.

In still another aspect, a direct fixation track rail fastener includes a rail plate having a lower, substrate facing side, an upper side, a clip shoulder having a clip tunnel formed therein to receive a prong of a rail clip, and a heel support surface adjacent to the clip shoulder. The clip tunnel includes a floor, and a plurality of clip contact faces, finite in number, located vertically above the floor and defining a first prong contact line and a second prong contact line extending through the clip tunnel. The first prong contact line and the second prong contact line define a cylinder extending in a fore-aft direction through the clip tunnel and are located less than 180° apart on the cylinder.

DETAILED DESCRIPTION

Figure 1:
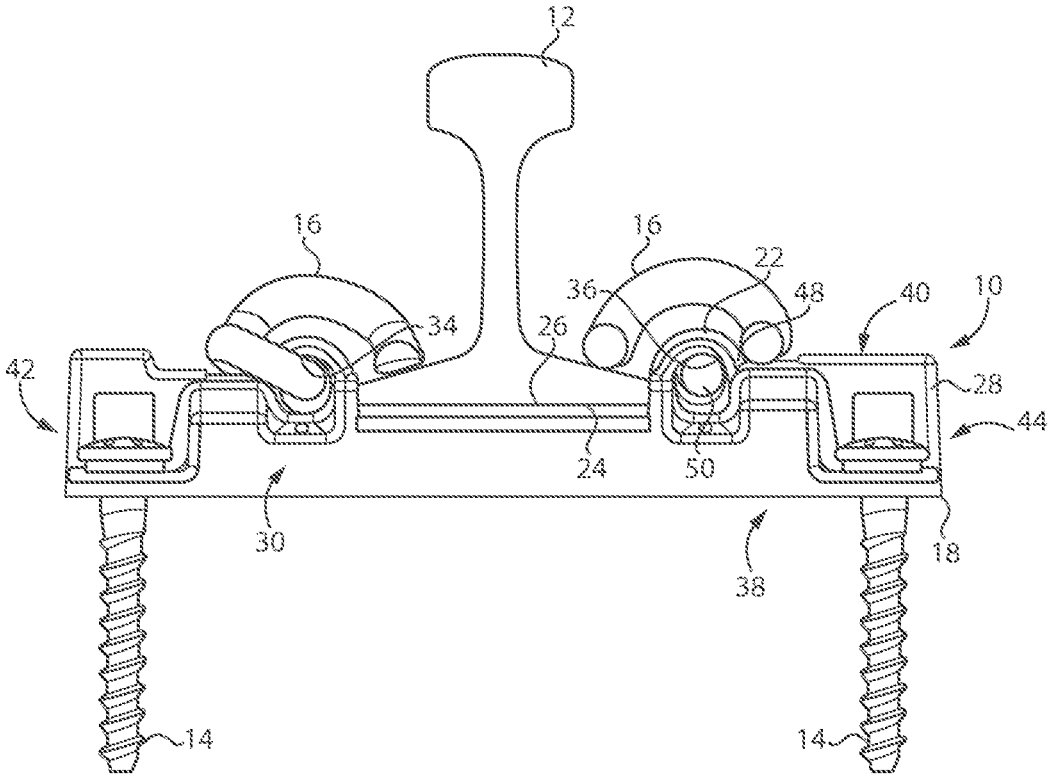
FIG. 1 is diagrammatic view of a direct fixation track rail fastener supporting a track rail for service, according to one embodiment.

Referring to FIG. 1, there is shown a direct fixation track rail fastener 10, according to one embodiment. Fastener 10 is shown as it might appear supporting a section of track rail 12 and includes a plurality of downwardly extending substrate anchors 14 structured to fasten track rail 12 to an underlying substrate such as a wooden tie, a concrete tie, poured concrete, or another suitable substrate. Fastener 10 includes a plurality of rail clips 16. Rail clips 16 may include so called E-Clips in some embodiments.

Figure 2:
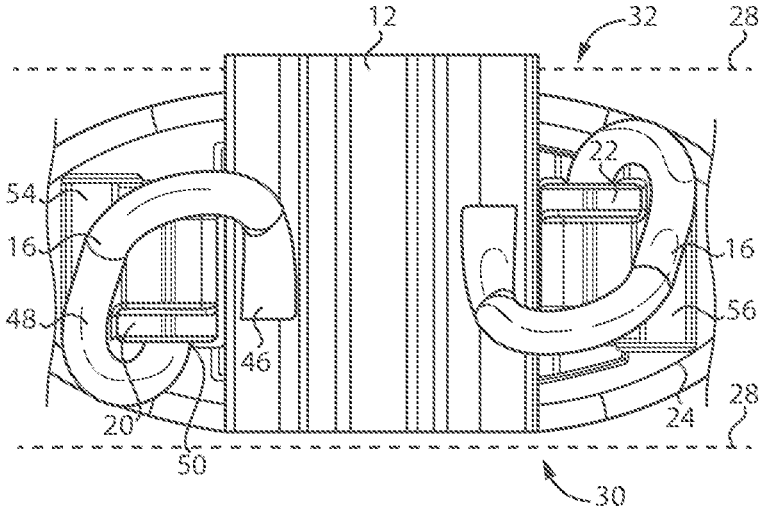
FIG. 2 is a top view of portions of the fastener of FIG. 1 with an elastomeric jacket removed.

Fastener 10 includes a fastener body 18 having a first clip shoulder 20, a second clip shoulder 22, and a rail plate 24 having an upward facing rail contact surface 26 positioned laterally between first clip shoulder 20 and second clip shoulder 22 and extending in a fore-aft direction between a fastener body forward edge 30 visible in the view of FIG. 1 and a fastener body back edge 32 as shown in FIG. 2. Fastener body 18 further includes a lower, substrate facing side 38, and an upper side 40. First heel support service 54 upon upper side 40 extends in the fore-aft direction between fastener body forward edge 30 and fastener body back edge 32, and in a lateral direction between clip shoulder 22 and a fastener body lateral edge 44. First heel support surface 54 is laterally outward of first clip shoulder 20. Fastener body 18 also includes a second heel support surface 56 that is analogously configured, laterally outward of second clip shoulder 22, and a second lateral edge 42.

Figure 3:
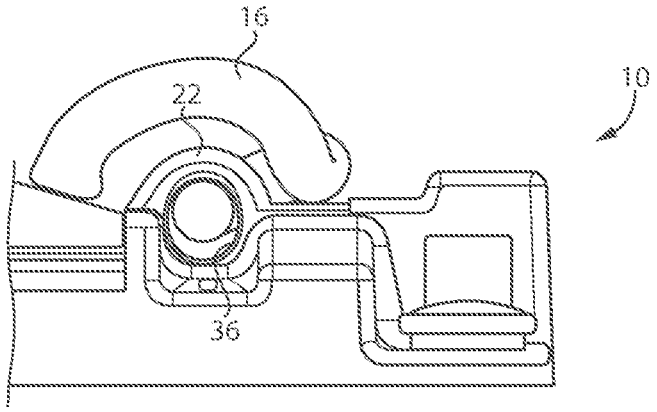
FIG. 3 is a diagrammatic view of a portion of a fastener as in FIG. 1.
Figure 4:
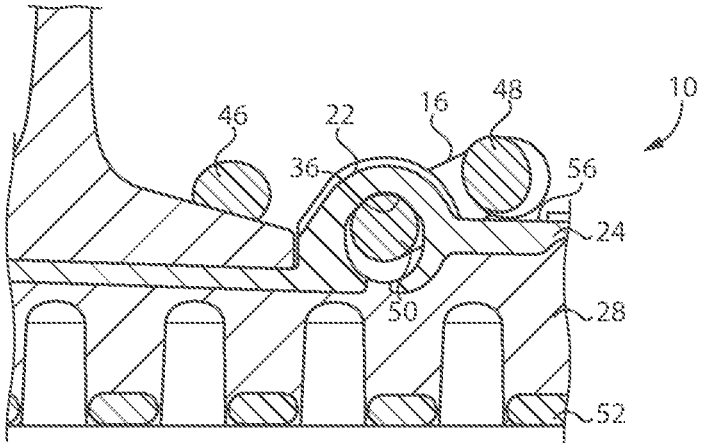
FIG. 4 is a sectioned view of portions of a fastener as in FIG. 1 and FIG. 3.

First clip shoulder 20 and second clip shoulder 22 include a first clip tunnel 34 and a second clip tunnel 36, respectively, each extending in the fore-aft direction. Focusing now on FIGS. 2, 3, and 4, fastener body 18 may also include a base plate 52. An overmolded jacket 28 formed, for example of an elastomeric material, and at least partially encases rail plate 24 and base plate 52, and electrically isolates those parts from one another. Jacket 28 is thus non-metallic, and each of rail plate and base plate 52 may be metallic.

Each rail clip 16, hereinafter referred to at times in the singular, may include a toe 46 that contacts track rail 12, a heel 48 contacting a corresponding one of heel support surfaces 54 and 56, and a prong 50 received and supported in a corresponding one of first clip shoulder 20 and second clip shoulder 22. Rail clip 16 may be hammered into place to position prong 50 within the corresponding clip tunnel 36 and thereby provide a downward clamping force via toe 46 on track rail 12. An upward clamp load from rail clip prong 50 is reacted by clip shoulder 22 within clip tunnel 36.

When positioned for service, heel 48 contacts heel support surface 56 and counteracts rotation of the respective rail clip 16. Clip prong 50 within clip tunnel 36 provides the clamping force to toe 46 and heel 48. In service, track rail 12 may move longitudinally due to thermal expansion and contraction or car braking forces transferred to track rail 12 by frictional forces. Based on the clamping of toe 46, against track rail 12, toe 46 tends to also engage in longitudinal movement. One rail clip may be urged out of its respective shoulder while another rail clip on the opposite side of the track rail is urged into its shoulder. In conventional strategies, a clip heel has a single point of contact with the heel support surface, and single line contact between the clip prong and clip tunnel. Over the course of time, the rail clip tends to rotate during longitudinal rail movement. Combined longitudinal and rotation forces can cause a rail clip to be pushed entirely out of the clip shoulder and leave the rail unclamped. As will be further apparent from the following description, the present disclosure addresses these and other phenomena.

Figure 5:
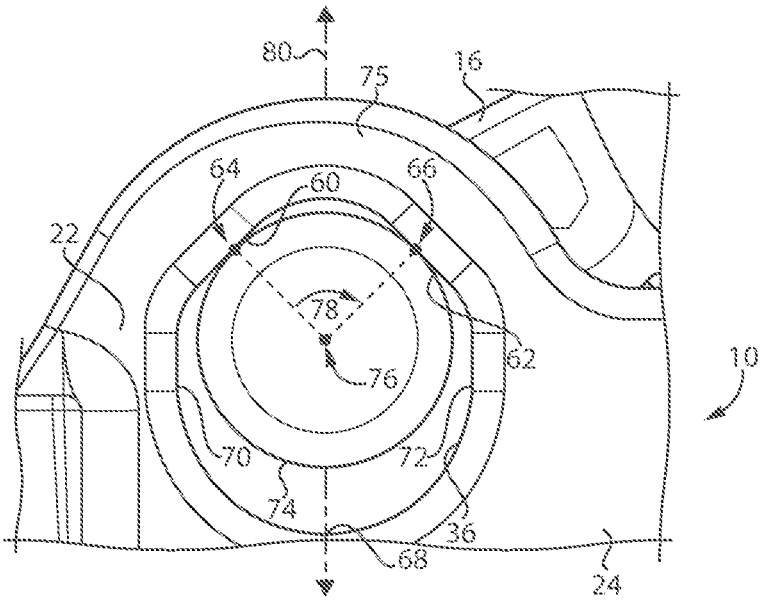
FIG. 5 is a close-up view of a portion of a fastener showing details of a clip shoulder, according to one embodiment.

Referring also now to FIG. 5 each of first clip tunnel 34 and second clip tunnel 36, referred to at times hereinafter in the singular, may be formed in part by a plurality of clip contact faces 60 and 62. Clip contact faces 60 and 62 are finite in number, and oriented to react an upward clamp load from rail clip prong 50 and define a first prong contact line 64 and a second prong contact line 66 each extending in the fore-aft direction through clip tunnel 36. Clip tunnel 36 may also include a floor 68, and each of a first side surface 70 and a second side surface 72 extending vertically upward from floor 68. Clip contact faces 60 and 62 are located vertically above floor 68. First prong contact line 64 and second prong contact line 66 may define a cylinder 74 having a cylinder axis 76 extending in the fore-aft direction through clip tunnel 36. First prong contact line 64 and second prong contact line 66 may be located less than 180° apart on cylinder 74. In an embodiment, first prong contact line 64 and second prong contact line 66 are located approximately 90° or less apart on cylinder 74. The term "approximately" means generally and suitably for an intended purpose, such as within measurement error or another standard of tolerance as would be understood by a person skilled in the track rail fastening field. First prong contact line 64 and second prong contact line 66 may together define an upwardly opening angle 78 having a vertex at axis 76 of cylinder 74. Upwardly opening angle 78 may be symmetric about a vertical plane 80 through clip shoulder 22.

In an embodiment, each of first clip shoulder 20 and second clip shoulder 22 forms an arch 75. Each respective plurality of clip contact faces 60 and 62 may be within the respective arch 75. As can also be seen from the drawings clip contact faces 60 and 62 may include an inboard clip contact face 60 closer to track rail 12, and an outboard clip contact face 62 closer to lateral edge 44. Clip contact faces 60 and 62 may be planar in some embodiments. In other embodiments, and as illustrated in FIG. 5, clip contact faces 60 and 62 may be convex to the respective clip tunnel 36. The plurality of clip contact faces 60 and 62 may include a total of two clip contact faces, although the present disclosure is not thereby limited.

Figure 6:
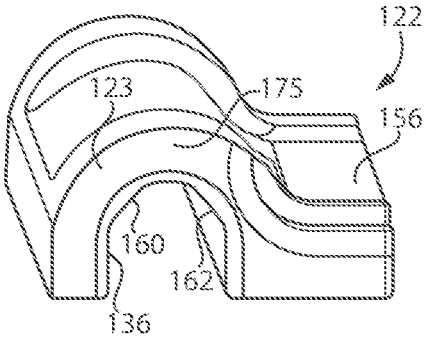
FIG. 6 is a diagrammatic view of a clip shoulder component, according to one embodiment.

Referring to FIG. 6, there is shown a clip shoulder component 122 that could be suitably attached such as by welding to a rail plate in a direct fixation fastener. While in some embodiments, including the embodiment of FIGS. 1-5, a clip shoulder having a clip tunnel can be formed integrally with a rail plate such as by casting, in other embodiments a separate component piece such as component 122 can be separately manufactured and attached. Clip shoulder component 122 includes a heel support surface 156, and a clip tunnel 136 in a shoulder 123 that includes an arch 175. Arch 175 may include clip contact faces 160 and 162 generally configured to perform analogously to other clip contact faces as discussed herein. Clip contact faces 160 and 162 may be planar.

Figure 7:
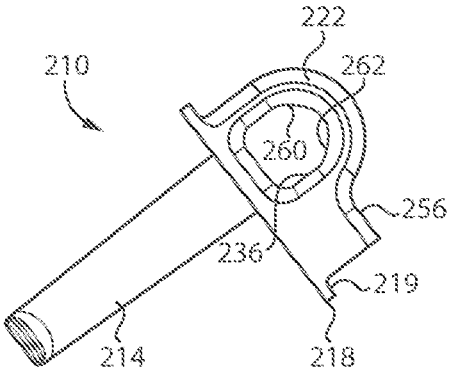
FIG. 7 is a diagrammatic view of a track rail fastener, according to another embodiment.
Figure 8:
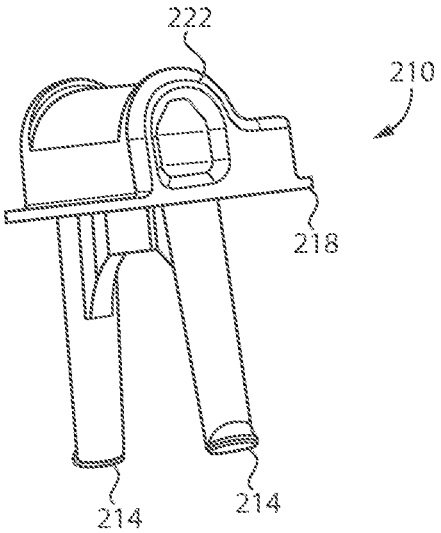
FIG. 8 is another diagrammatic view of the track rail fastener as in FIG. 7.

Referring now to FIGS. 7 and 8 there is shown a track rail fastener 210 according to another embodiment. Track rail fastener 210 includes a clip shoulder 222, in a fastener body 218. Clip shoulder 222 includes therein a clip tunnel 236. Clip tunnel 236 is formed in part by clip contact faces 260 and 262 again configured generally analogously to other clip contact faces discussed herein. A heel support surface 256 is positioned laterally of clip shoulder 222. An anchor 214 such as might be used for cast-in retention of fastener 210 in concrete extends generally downwardly. In the illustrated embodiment, anchor 214 includes two similarly configured downwardly depending components as can be seen in FIG. 8. A protruding lip 219 to be fitted under a section of track rail or a support mat, plate, or the like beneath a track rail protrudes upon fastener body 218.

INDUSTRIAL APPLICABILITY

Referring to the drawings generally, as discussed above when placed in service traditional fasteners may have a single point of contact between a cylindrical or partially cylindrical clip tunnel surface and a cylindrical prong of a rail clip. The single line of contact in known designs can fail to prevent wiggling of a rail clip in response to dimensional changes in components, vibrations, and other forces.

According to the present disclosure, a rail clip including a prong that is held via clamping forces in contact along two lines of contact with a top surface or roof of a clip tunnel will tend not to wiggle in the manner associate with prior designs. In this general way the present disclosure can provide desirable performance with regard to clip retention and overall improved rail stability and service life.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A direct fixation track rail fastener comprising:

a fastener body including a first clip shoulder, a second clip shoulder, and a rail plate having an upward facing rail contact surface positioned laterally between the first clip shoulder and the second clip shoulder and extending in a fore-aft direction between a fastener body forward edge and a fastener body back edge; and the first clip shoulder and the second clip shoulder including a first clip tunnel and a second clip tunnel, respectively, each formed in part by a plurality of clip contact faces, finite in number, oriented to react an upward clamp load from a rail clip prong, defining a first prong contact line and a second prong contact line each extending in the fore-aft direction, and the plurality of clip contact faces are planar, or convex to the respective clip tunnel.

2. The fastener of claim 1 wherein each of the first clip shoulder and the second clip shoulder forms an arch, and each plurality of clip contact faces is within the respective arch.

3. The fastener of claim 2 wherein the first prong contact line and the second prong contact line define a cylinder extending in a fore-aft direction through the clip tunnel, and are located approximately 90° or less apart on the cylinder.

4. The fastener of claim 3 wherein the plurality of clip contact faces are planar to the respective clip tunnel.

5. The fastener of claim 1 wherein each plurality of clip contact faces includes an inboard clip contact face and an outboard clip contact face symmetric about a vertical plane through the clip shoulder.

6. The fastener of claim 1 wherein the first clip shoulder and the second clip shoulder are formed integrally with the rail plate.

7. The fastener of claim 6 wherein the rail plate further includes a first heel support surface located laterally outward of the first clip shoulder, and a second heel support surface located laterally outward of the second clip shoulder.

8. The fastener of claim 7 further comprising a first rail clip and a second rail clip each having a prong supported in one of the first clip shoulder or the second clip shoulder, a heel in contact with one of the first heel support surface or the second heel support surface, and a toe positioned to clamp a track rail upon the upward facing rail support surface.

9. The fastener of claim 1 wherein each plurality of clip contact faces includes a total of two clip contact faces.

10. The fastener of claim 1, wherein in each of the first clip tunnel and the second clip tunnel, the first prong contact line and the second prong contact line together define an upwardly opening angle having a vertex at an axis of the cylinder, and the upwardly opening angle is symmetric about a vertical plane defined through the clip shoulder.

11. A track rail fastener comprising:

a fastener body including a lower, substrate-facing side, and an upper side, and including a heel support surface upon the upper side extending in a fore-aft direction between a fastener body forward edge and a fastener body back edge, and in a lateral direction between a clip shoulder and a fastener body lateral edge;

the clip shoulder including a clip tunnel extending in the fore-aft direction, and formed in part by a plurality of clip contact faces;

the plurality of clip contact faces defining a first prong contact line and a second prong contact line on a cylinder extending in the fore-aft direction through the clip tunnel; and the first prong contact line and the second prong contact line together defining an upwardly opening angle having a vertex at an axis of the cylinder, and the upwardly opening angle is symmetric about a vertical plane defined through the clip shoulder.

12. The fastener of claim 11 wherein the plurality of clip contact faces includes a total of two clip contact faces.

13. The fastener of claim 11 wherein the plurality of clip contact faces are planar, or convex to the clip tunnel.

14. The fastener of claim 11 wherein the upwardly opening angle is approximately 90° or less.

15. The fastener of claim 11 wherein the shoulder includes an arch, and the plurality of clip contact faces are within the arch.

16. The fastener of claim 11 wherein the fastener body further includes substrate anchors extending downwardly from the lower, substrate facing side.

17. A direct fixation track rail fastener comprising:

a rail plate including a lower, substrate facing side, an upper side, a clip shoulder having a clip tunnel formed therein to receive a prong of a rail clip, and a heel support surface adjacent to the clip shoulder;

the clip tunnel includes a floor, a plurality of clip contact faces, finite in number, located vertically above the floor and defining a first prong contact line and a second prong contact line extending through the clip tunnel, and a first side surface and a second side surface both extending from the floor to a respective one of the plurality of clip contact faces;

wherein the first prong contact line and the second prong contact line define a cylinder extending in a fore-aft direction through the clip tunnel and are located less than 180° apart on the cylinder; and the plurality of clip contact faces are planar or convex to the clip tunnel.

18. The fastener of claim 17 wherein the plurality of clip contact faces include a first clip contact face and a second clip contact face symmetric about a vertical plane extending in the fore-aft direction through the clip tunnel.

19. The fastener of claim 17 wherein the clip shoulder includes an arch, and the plurality of clip contact faces are within the arch.

20. The fastener of claim 17, wherein the first prong contact line and the second prong contact line together define an upwardly opening angle having a vertex at an axis of the cylinder, and the upwardly opening angle is symmetric about a vertical plane defined through the clip shoulder.

* * * * *